US011141627B2

(12) United States Patent
Piumatti

(10) Patent No.: US 11,141,627 B2
(45) Date of Patent: Oct. 12, 2021

(54) APPARATUS FOR WEARING FINS

(71) Applicant: Paolo Piumatti, Ustica (IT)

(72) Inventor: Paolo Piumatti, Ustica (IT)

( * ) Notice: Subject to any disclaimer, the term of this patent is extended or adjusted under 35 U.S.C. 154(b) by 0 days.

(21) Appl. No.: 16/464,984

(22) PCT Filed: Nov. 28, 2017

(86) PCT No.: PCT/IB2017/057435
§ 371 (c)(1),
(2) Date: May 29, 2019

(87) PCT Pub. No.: WO2018/100482
PCT Pub. Date: Jun. 7, 2018

(65) Prior Publication Data

US 2019/0321685 A1 Oct. 24, 2019

(30) Foreign Application Priority Data

Nov. 30, 2016 (IT) ..... 102016000121316

(51) Int. Cl.
*A63B 31/08* (2006.01)
*A63B 31/11* (2006.01)
*A47G 25/90* (2006.01)

(52) U.S. Cl.
CPC ..... *A63B 31/11* (2013.01); *A47G 25/90* (2013.01); *A63B 2225/09* (2013.01)

(58) Field of Classification Search
CPC ..... A63B 31/08; A63B 31/10; A63B 31/11; A63B 2225/09; A47G 25/80; A47G 25/90
USPC ..... 441/55, 60, 61, 62, 63, 64
See application file for complete search history.

(56) References Cited

U.S. PATENT DOCUMENTS

| | | | | |
|---|---|---|---|---|
| 4,017,925 | A | 4/1977 | Shamlian | |
| 4,795,384 | A | 1/1989 | Hattori | |
| 5,083,954 | A * | 1/1992 | Jacobs | A63B 31/11 441/64 |
| 10,058,737 | B2 * | 8/2018 | Piumatti | A47G 25/80 |
| 2017/0095698 | A1 * | 4/2017 | Piumatti | A63B 31/11 |

FOREIGN PATENT DOCUMENTS

| | | | |
|---|---|---|---|
| DE | 102014015712 | A1 | 4/2016 |
| EP | 0572853 | A1 | 12/1993 |
| EP | 0687484 | A1 | 12/1995 |
| FR | 2744639 | A1 | 8/1997 |
| IT | 1423616 | | 5/2014 |
| WO | 9718014 | A1 | 5/1997 |

(Continued)

OTHER PUBLICATIONS

International Search Report dated Feb. 13, 2018 from counterpart PCT App No. PCT/IB2017/057435.

*Primary Examiner* — Daniel V Venne
(74) *Attorney, Agent, or Firm* — Shuttleworth & Ingersoll, PLC; Timothy J. Klima

(57) ABSTRACT

An apparatus for putting on flippers including means for retaining a user's foot inside a shoe of the flipper, the retaining means being mechanically connected to means for connection to the shoe of the flipper, the retaining means also being pivoted to the connection means by a hinge, the apparatus being characterised in that it comprises means for adjusting the mutual position between the retaining means and the connecting means for adapting the apparatus to the foot of the user.

9 Claims, 4 Drawing Sheets

(56) References Cited

FOREIGN PATENT DOCUMENTS

| | | | |
|---|---|---|---|
| WO | 9912612 | A1 | 3/1999 |
| WO | 0066231 | A1 | 11/2000 |
| WO | 2015177695 | A1 | 11/2015 |

* cited by examiner

APPARATUS FOR WEARING FINS

This application is the National Phase of International Application PCT/IB2017/057435 filed Nov. 28, 2017 which designated the U.S.

This application claims priority to Italian Patent Application No. 102016000121316 filed Nov. 30, 2016, which application is incorporated by reference herein.

TECHNICAL FIELD

The invention relates to an apparatus for putting on flippers.

BACKGROUND ART

In particular the term flippers relates to all footwear which can be used for various sporting activities, such as underwater diving, swimming and so on.

A possible application of the invention relates to flippers, to which reference will be made by way of example below.

Flippers for swimming are generally provided with a large propulsion portion due to the presence of a flexible blade (flipper).

Swimming flippers have, in addition to the flexible blade, a seating in the form of a shoe integral with the blade itself and enabling insertion of the foot of person wearing the flipper, for example the swimmer or underwater swimmer. The shoe, in particular, comprises a rear part which does not contain the foot, therefore with an opening at the heel, for introducing the foot in the housing thereof.

Normally, for retaining the foot in the opening, this type of flipper has a strap or elastic belt hooked laterally of the flipper shoe.

In order to fit the flippers and fasten them to the underwater swimmer's foot, using elastic straps or other known fastening means, the underwater swimmer has to count on the assistance of another person or has to crouch with movements that are laborious and involve bending.

These movements are conditioned, for most users, by their own weight and the weight of the equipment being carried, as the user has to stand on a single leg for the time needed to put on each flipper, and this generates significant difficulty.

This drawback has been brilliantly overcome by the apparatus described in Italian patent application number 1.423.616 of the same Applicant as this invention, which is incorporated herein by reference for completeness of description.

This apparatus comprises means for retaining the foot inside a shoe of the flipper where the retaining means are mechanically connected with and pivoted to the removable attaching means of the shoe, the removable attaching means can be associated in a removable fashion to a portion of the base of the shoe.

In particular, the removable attaching means comprise a pair of U-shaped or substantially ring-shaped jaws to attach in a secure manner to the base of the show.

However, this apparatus does not have the possibility of adapting to the size of the wearer's foot, in particular to the length of the foot and, therefore, the only means of adaptation is given just by the dimensions of the flipper used.

The need is therefore felt of providing an apparatus for flippers with special connections that are easily adjustable as a function of the actual size of the wearer's foot.

Adjustment systems are described in U.S. Pat. No. 4,795,384 and EP0687484. These systems are integrated with the flippers and do not obviate demanding movements and hence the user having to bend, made necessary so as to reach the foot with the hands.

A further prior art disclosure is described in patent application WO9912612. It describes a flipper in which the normal strap is substituted with an apparatus having two static positions, but without any adjustment system.

In effect, a significant drawback is due to the fact that is no possibility of adjustment for adaptation to the length of the wearer's foot.

A further example of prior art is described in French patent application FR2744639. This patent describes a flipper which has a shoe, joined to the flipper, and a separate heel. The heel has a tongue, projecting forwards, which engages in an opening beneath the flipper. The position of the heel is adjustable as a function of the length of the user's foot. The tongue has a slot which has saw-tooth elements along an edge thereof. An opening clip, with a hook on a free end thereof, engages with the teeth to keep the tongue in position. The tongue is released by pressing on a pin which protrudes from the opening. However, the position of the heel as a function of the length of the wearer's foot is adjustable, but it has the drawback of not having a system for fitting the foot securely and the entire system is rigid and in order to release the flipper it is necessary to intervene manually on the tongue, freeing the heel from the flipper.

More specifically, the drawback of this technique is that it is necessary for the user to act with the hands, in precarious equilibrium, for inserting the tongue in the clip, and this action has features of great uncertainty, difficulty and high instability, being extremely risky for the reasons set out in the foregoing.

A disadvantage shared by the entire prior art described above is that the flippers must be made with the provided devices and therefore these apparatuses are not applicable to traditional flippers already present on the market, or already in the possession of underwater swimmers.

Aim of the Invention

An aim of the invention is to obviate the drawbacks of the prior art described above.

A further aim is to provide an apparatus for fastening the foot of a person in an item of footwear which can be easily fixed without the use of the person's hands and be easily released with minimum force, all done in conditions of maximum safety.

A further aim of the invention is to provide an apparatus which can be used in flippers of the conventional type without the need for structural modifications to the shoe of the flipper or to a part thereof.

A further aim of the invention is to provide an apparatus for fastening the foot of a person into an item of footwear, such as a swimming flipper with the particular feature of adapting to the length of the foot. The apparatus might also be integrated directly in a flipper.

The technical purpose indicated and the aims specified are substantially achieved by an apparatus for putting on flippers as disclosed herein.

BRIEF DESCRIPTION OF THE DRAWINGS

Further characteristics and advantages of this invention are more apparent in the detailed description below, with reference to a preferred, non-limiting embodiment of a machine as illustrated in the accompanying drawings, in which.

DETAILED DESCRIPTION OF PREFERRED EMBODIMENTS OF THE INVENTION

Figure 1:
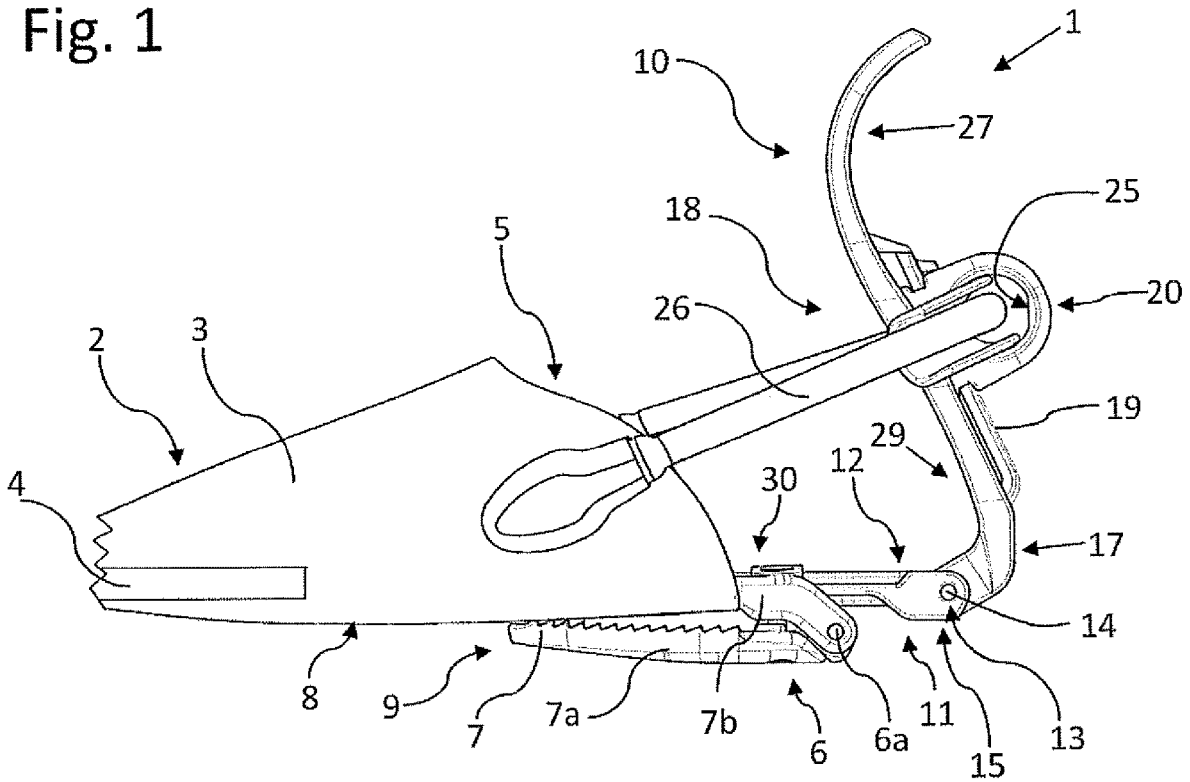
FIG. 1 illustrates a partial schematic side view, and with some parts removed for greater clarity, of an apparatus for putting on flippers according to the invention, when the apparatus is in conditions of use.

With reference to the accompanying figures, reference numeral 1 denotes a machine for putting on flippers 2 (illustrated partially in FIGS. 1 and 7), such as, for example, flippers for underwater swimmers, defined in their entirety as users, to which explicit reference will be made without losing in terms of general applicability.

In the described embodiment reference the term "flippers" will be used to refer to all footwear which can be used for various sporting activities such as underwater immersion, swimming and so on.

In particular the flipper 2 to which reference is made herein comprises a part for inserting the underwater swimmer's foot which will be referred-to as a shoe 3, and a part that comprises a blade 4 which is constituted for generating a large portion of propulsion.

The blade 4 has a flexible laminar shape, constituting the flipper proper, and is illustrated only partially in FIG. 1, the flipper 2 being interrupted by a saw-toothed line.

Further, the shoe 3 of the flipper 2 is without a rear containing part, that is to say, a rear part open at the position of the user's heel, so as to enable introduction of the foot in a housing 5, which constitutes the seating for the foot.

Figure 6:
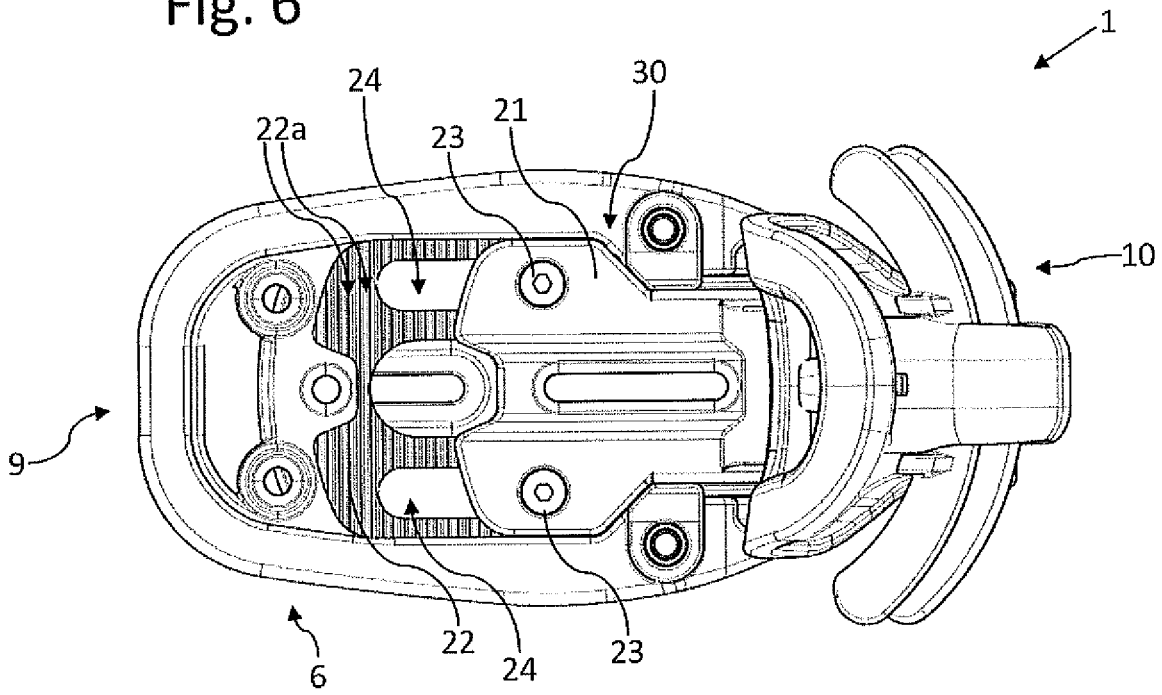

With reference to FIGS. 1 and 6, the apparatus 1 comprises a retaining device 10 for retaining the foot of the underwater swimmer in the correct position inside the housing 5 of the flipper 2 and comprises a connecting device 9 for connecting to the flipper 2.

The retaining device 10 and the connecting device 9 are mechanically connected to one another.

It should be noted that in the embodiment of FIGS. 1 to 6, the connecting device 9 allows the apparatus 1 to be connected to the shoe 3 of the flipper 2 in a removable fashion.

Figure 7:
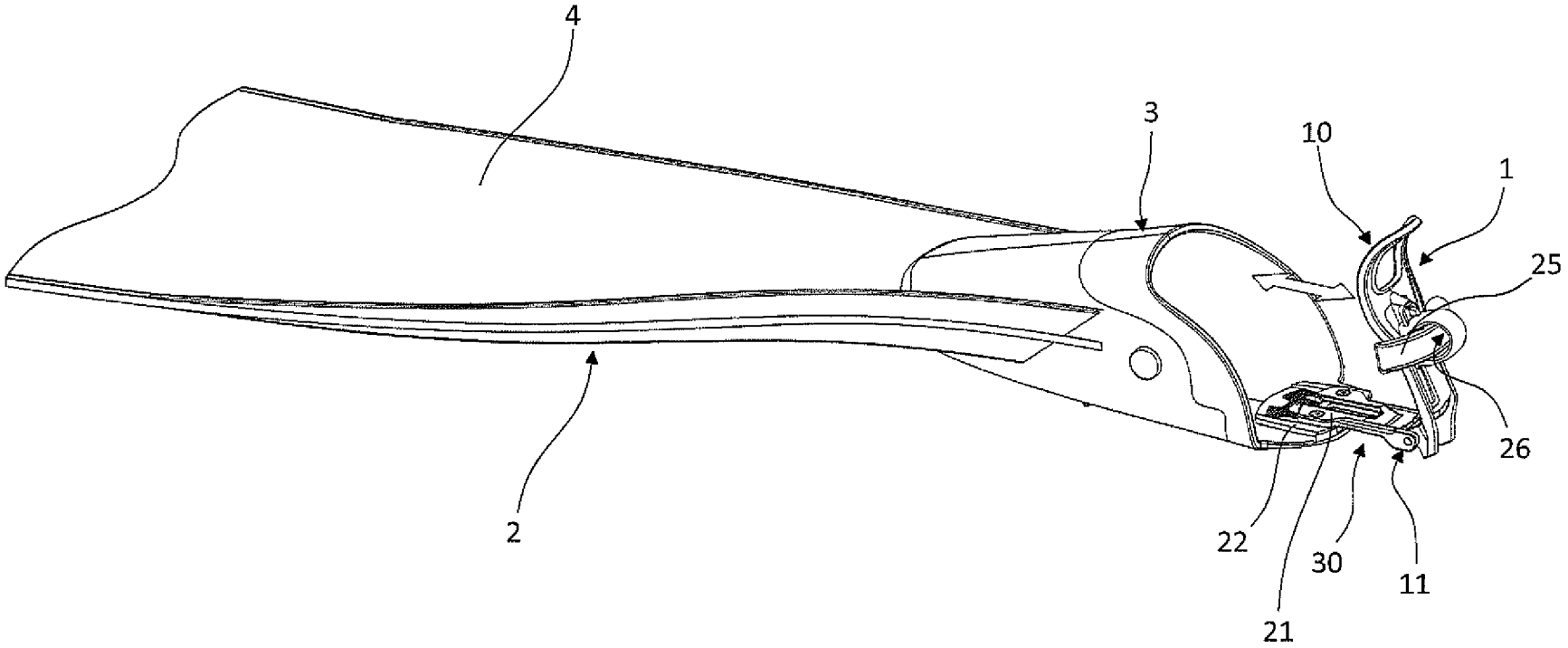
FIG. 7 illustrates a flipper comprising the apparatus, according to the present invention, built as a single piece with the flipper.

FIG. 7 illustrates a flipper 2 which comprises the apparatus 1 for putting it on, that is, the apparatus 1 constitutes a single piece with the flipper 2 since it is connected to it in an irremovable fashion.

In that way, the connecting device 9 may be considered as a device by which the apparatus is connected to the flipper 2 without the possibility of removal.

In FIGS. 1 to 6, the connecting device 9 for connecting to the flipper 2 comprises a pair of jaws 6, which in a preferred embodiment are each made with a respective plate 7, defining a substantially "U" or ring shape.

The two plates 7 are facing each other and spaced by an amount such as to enable insertion of a base or sole 8 of the shoe 3 of the flipper 2.

The distance between the two plates 7 is therefore approximately the thickness of the material which forms the sole 8.

The two plates 7 of the jaws 6 are pivoted to each other on an axis, parallel to the plane on which they lie, through a pair of pins 6*a*, which are coaxial with each other.

The connecting device 9 is therefore associable in a removable fashion to a portion of the base 8 of the shoe 3, at least according to the embodiment illustrated in FIGS. 1 to 6.

In this way, in use, the sole 8 of the shoe 3 is interposed between a lower plate 7*a*, positioned beneath the sole 8 of the flipper 2, and an upper plate 7*b*, positioned above the sole 8 and partly inside the housing 5 (see FIG. 1).

In the embodiment illustrated, one of the jaws 6 of the connecting device 9 is connected to a connecting element 11 for connecting between the jaw 6, consequently between the connecting device 9, and the retaining device 10.

In the connecting element 11 there is a through hole 13 with an axis parallel to the plane in which the plates 7 lie. A spindle 14 is present internally of the hole.

The spindle 14 in the hole 13 constitutes a hinge 15 in which the retaining device 10 is pivoted.

The retaining device 10 and the connecting device 9 are mechanically pivoted to each other by means of the hinge 15.

The retaining device 10 is partly located in the seat of a recess 16 made in the end 12 of the connecting element 11 and has a passage which is able to partly house the spindle 14, which passes through a suitable through hole.

The spindle 14 can be rigidly connected to the connecting element 11 and the retaining device 10 remains free to rotate about it.

Vice versa, the spindle 14 can be rigidly connected to the retaining device 10 and free to rotate inside the holes 13 of the connecting element 11.

The retaining device 10 of the heel of the foot comprises a structure which has various characteristics.

In particular, the retaining device 10 comprises a first end 17 that engages in the recess 16.

In the proximity of the first end 17 there is a zone 18 for opposing the heel, which in turn comprises a guide 19 joined on the opposite side relative to a die 29 having an anatomical shape, in use facing towards and in contact with the heel of the wearer.

This die 29 constitutes a supporting seat of the heel when the apparatus is in use.

A slider 20, movable between an upper position and a lower position, is slidably mounted on the guide 19 to be able to slide along the guide 19, thereby being connected to the retaining device 10.

On the slider 20 is made a seating 25 for containing an elastic strap 26 which forms part of the flipper 2 (see FIG. 1).

The strap 26, housed in the seat 25, can slide the slider 20, when the action of its elastic force is overcome by the wearer's foot.

The retaining device 10 comprises a second upper end 27, opposite the first end 17, which extends in an inclined and/or curved fashion so as to facilitate rotation about the hinge 15.

The apparatus 1 also comprises an adjustment device 30 (illustrated in FIGS. 2 to 6) for adjusting the reciprocal position between the retaining device 10 and the connecting device 9.

The adjustment device 30 is adjustable between two limit positions mutually towards and away between the retaining device 10 and the connecting device 9.

The adjustment device 30 comprises an upper plate 21 and a lower plate 22, which are able to couple together and be mutually positioned.

Their reciprocal position being secured by a locking device, for example two threaded fasteners, shown as screws 23, according to the embodiment illustrated.

More specifically, the upper plate 21 is rigidly connected to the connecting element In other words, the connecting element 11 makes the upper plate 21 of the adjustment device 30 integral with the retaining device 10.

The above considerations regarding the mode of connection between the connecting element 11 and the retaining device 10 remain valid.

With reference to the jaws 6, the upper plate 21 is rigidly connected to one of the jaws 6.

The lower plate 22 is connected to a jaw 6, in particular to the relative plate 7*b*.

It should be noted that the reference jaw 6 for the connection of the upper plate 21 and for the bottom plate 22 is the same.

The mutual positioning between the plates 21 and 22 is made possible by the sliding of the locking device, that is to say, of the screws 23, in mutual slots 24.

The stability of the positioning between the plates 21 and 22 is advantageously achieved by the presence, on their sides facing each other, of grooves 21*a* and 22*a* which can be releasably and adjustably coupled to each other and which are able to reach a plurality of stable adjusted axial positions following the blocking of the locking device, that is to say, of the screws 23, but even if the screws 23 are not completely tightened. Loosening of the screws 23 places the plates in an uncoupled state where a relative axial position between the plates (and between the connecting device and the retaining device) can be adjusted.

Figure 3:
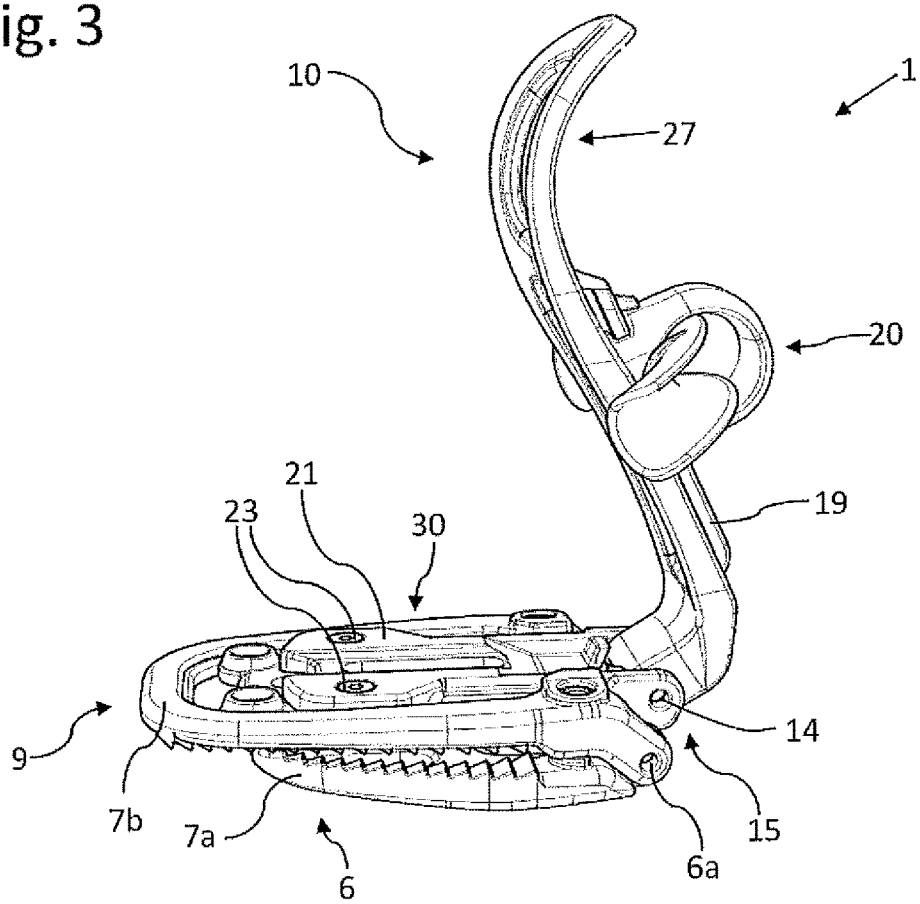
FIGS. 3 and 4 each illustrate a partial schematic side view, with some parts removed for greater clarity, of the apparatus for putting on flippers according to the invention in a different position of use.
Figure 5:
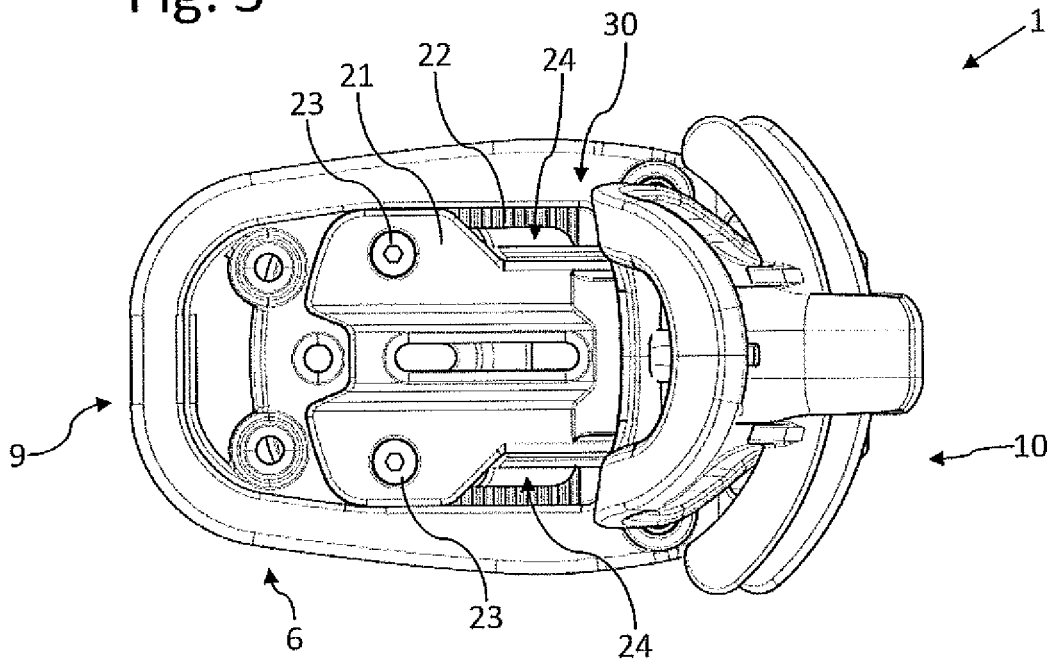
FIGS. 5 and 6 each illustrate a partial schematic top view, with some parts removed for greater clarity, of the apparatus for putting on flippers according to the invention in a different position of use, in particular in the respective positions of FIGS. 3 and 4.

FIGS. 3 and 5 illustrate the apparatus 1 with the adjustment device 30 in the mutually towards end position in which the plates 21 and 22 are positioned in such a way that the retaining device 10 is as close as possible to the shoe 3 of the flipper 2.

Figure 2:
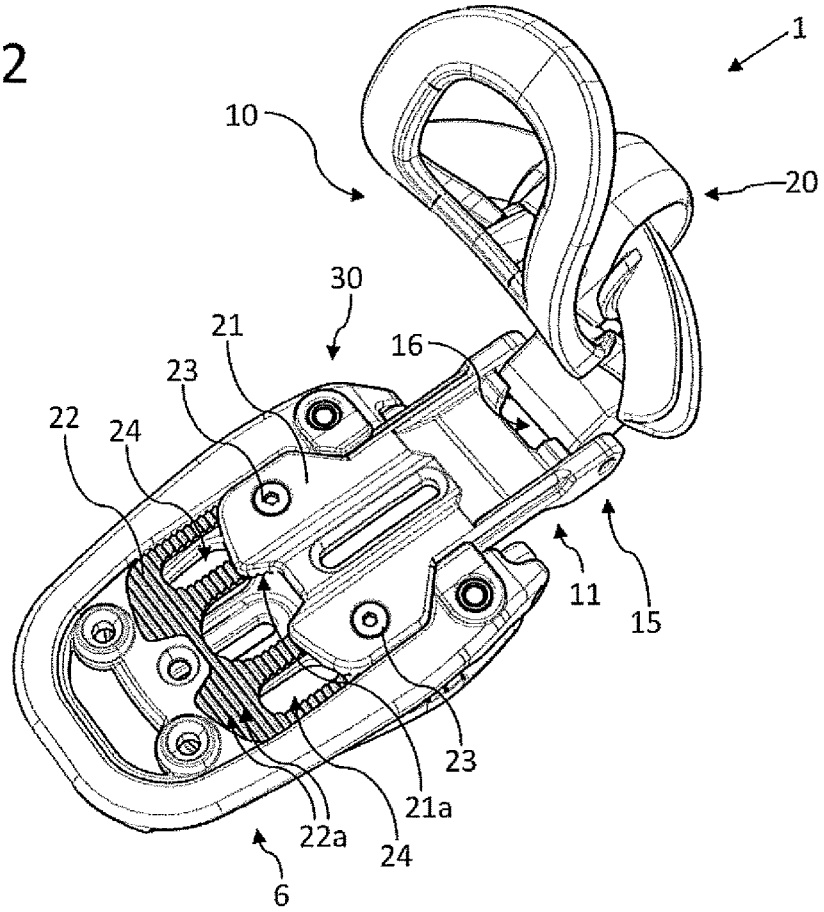
FIG. 2 illustrates a schematic, partial perspective view, with some parts removed for greater clarity, of the apparatus for putting on flippers according to the invention.
Figure 4:
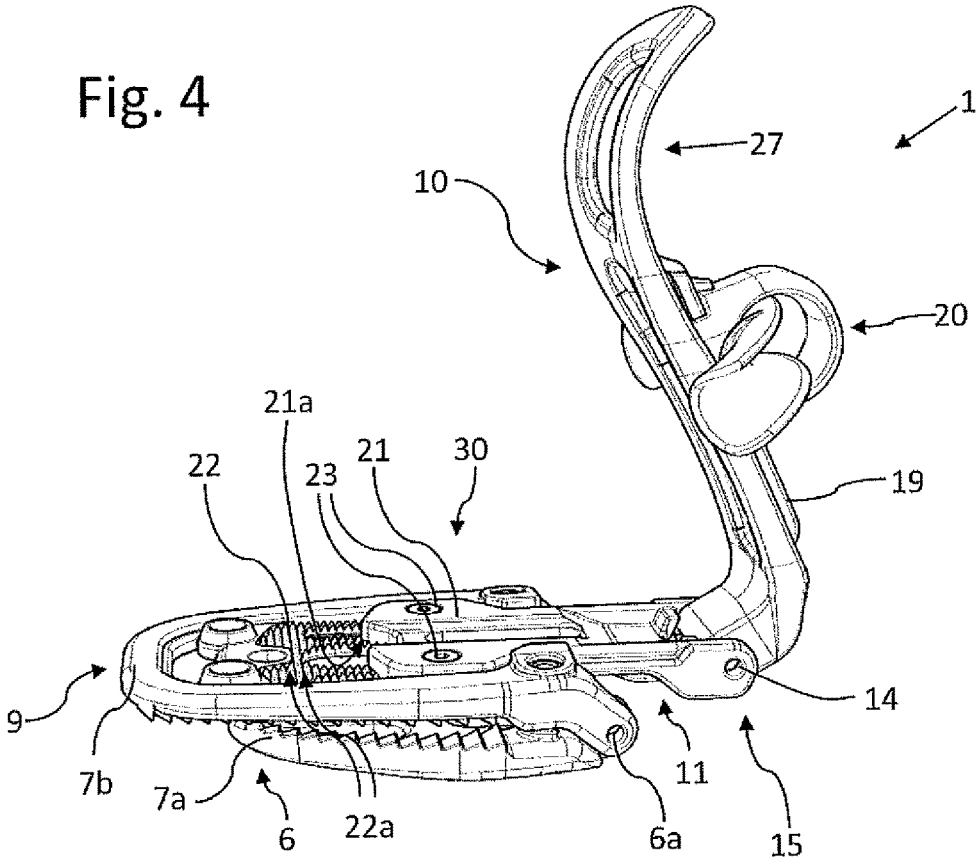

FIGS. 2, 4 and 6 illustrate, on the other hand, the apparatus 1 with the adjustment device 30 in the mutually away end position, in which the plates 21 and 22 are each other positioned in such a way that the retaining device 10 is as far away as possible from the shoe 3 of the flipper 2. The most advanced end position will be ideal for the user who has shorter feet, whilst the most retracted end position will be ideal for the user who has longer feet.

All the intermediate positions are adjustable and adaptable to all the intermediate lengths of the feet of the various users.

In use, after having manually secured the connecting device 9 to the sole 8 of the shoe 3, it will be sufficient to position the foot inside the shoe 3, without acting on the locking device, that is to say, keeping the screws 23 loose, in such a way that it allows the mutual sliding of the two plates 21 and 22.

After positioning the foot and allowing the retaining device 10 to reach its operating position, the two plates 21 and 22 must be mutually positioned in such a way as to reach the position of greatest comfort.

It will then be necessary to withdraw the foot from the shoe, taking care that the plates 21 and 22 no longer slide between each other, which easily maintain the position reached by means of the mutual coupling of the grooves 21*a* and 22*a*.

After withdrawing the foot from the shoe, the user must act on the locking device, tightening the screws 23, and from that moment the apparatus 1 will be perfectly adapted to the length of the user's foot without having to further make other adjustments.

The flipper is thus ready for each future use by the same user.

The apparatus 1 is, therefore, now be able to operate in exactly the same way as that described in Italian patent application number 1.423.616 of the same Applicant as this invention, which, above, has been incorporated herein in its entirety for completeness of description.

It should be noted that in the embodiment of FIG. 7 the connecting device 9 might also be integrated in the shoe 3 of the flipper 2, but that does not alter the fact that there is an adjustment device 30 for adjusting the distance of the retaining device 10 from the connecting device 9, and, therefore, from the shoe 3.

With reference to the flipper 2 wherein the apparatus 1 is integrated, all the considerations set out for the removable apparatus 1 apply with reference to the retaining device 10 and to the adjustment device 30.

In this sense, this solution does not comprise the use of the jaws 6, since they are not necessary, and, consequently, the lower plate 22 of the adjustment device 30 is connected to the shoe 3 of the flipper. Further modifications and improvements may be included without forsaking the scope of the invention as described herein.

The invention claimed is:

1. An apparatus for putting on a flipper, comprising:

a connecting device for connection to a shoe of the flipper;

a retaining device for retaining a user's foot inside the shoe of the flipper, the retaining device being mechanically connected to the connecting device, the retaining device including a guide and a slider slidably mounted on the guide for movement between a lower position on the guide and an upper position on the guide, the slider including a seat for positively connecting an elastic strap of the flipper to the retaining device in both the lower position and the upper position;

a hinge pivotally connecting the retaining device and the connecting device;

an adjustment device connected between the retaining device and the connecting device for adjusting a relative axial position between the retaining device and the connecting device;

wherein the adjustment device comprises an upper plate and a lower plate, both separate from the flipper and releasably coupled together and, in an uncoupled state, axially movable relative to one another for adjusting the relative axial position between the retaining device and the connecting device;

a connecting element connecting between the upper plate and the retaining device;

wherein the upper plate is rigidly connected to the connecting element; and wherein the connecting element is pivotally connected by the hinge to the retaining device.

2. The apparatus according to claim 1, wherein the adjustment device is adjustable between mutually towards and mutually away end positions between the retaining device and the connecting device.

3. The apparatus according to claim 1, wherein the adjustment device includes a threaded fastener connected between the upper plate and the lower plate for mutually locking the upper plate and the lower plate.

4. The apparatus according to claim 1, wherein the upper plate includes a plurality of axially spaced first grooves and the lower plate includes a plurality of axially spaced second grooves, the plurality of axially spaced second grooves being axially spaced to correspond to the axial spacing of the plurality of axially spaced first grooves such that the plurality of axially spaced first grooves are engageable with the plurality of axially spaced second grooves in a plurality of different axial positions to adjust a relative axial positioning between the upper plate and the lower plate; the plurality of axially spaced first grooves and the plurality of axially spaced second grooves being releasably and adjustably coupled to each other to provide for movement between the plurality of different axial positions.

5. The apparatus according to claim 1, wherein the connecting device is removable from the shoe and includes a pair of jaws for clamping a sole of the shoe.

6. The apparatus according to claim 5, wherein the lower plate of the adjustment device is rigidly connected to one of the pair of jaws.

7. A flipper comprising the apparatus according to claim 1.

8. The flipper according to claim 7, wherein the lower plate of the adjustment device is connected to the shoe of the flipper.

9. The apparatus according to claim 1, wherein the hinge includes a through hole positioned through the retaining device and the connecting device and a spindle positioned in the through hole connecting the retaining device and the connecting device and permitting relative rotation between the retaining device and the connecting device.

* * * * *